US008374516B2

(12) United States Patent
Ito

(10) Patent No.: US 8,374,516 B2
(45) Date of Patent: Feb. 12, 2013

(54) IMAGE FORMING APPARATUS WHICH INFORMS A USER THAT TONER DOES NOT EXIST IN AN EXCHANGEABLE DEVELOPER ACCOMMODATING SECTION

(75) Inventor: Yukio Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 368 days.

(21) Appl. No.: 12/533,076

(22) Filed: Jul. 31, 2009

(65) Prior Publication Data

US 2010/0046966 A1 Feb. 25, 2010

(30) Foreign Application Priority Data

Aug. 22, 2008 (JP) ..... 2008-214219

(51) Int. Cl.
*G03G 15/08* (2006.01)

(52) U.S. Cl. ..... 399/27; 399/255; 399/258

(58) Field of Classification Search ..... 399/27, 399/28, 30, 255, 258
See application file for complete search history.

(56) References Cited

U.S. PATENT DOCUMENTS

2005/0265738 A1* 12/2005 Ogata ..... 399/27

FOREIGN PATENT DOCUMENTS

JP 2000-238374 A 9/2000

* cited by examiner

*Primary Examiner* — David Gray
*Assistant Examiner* — Joseph S Wong
(74) *Attorney, Agent, or Firm* — Panitch Schwarze Belisario & Nadel LLP

(57) ABSTRACT

An image forming apparatus is supplied capable of informing user just after developer in an accommodating section is exhausted. In the apparatus, a developing section is used for forming and developing an electrostatic latent image through developer; an accommodating section accommodates the developer; a supplying section makes the accommodating section be installed exchangeably and supplies the developer to the developing section; a space amount obtaining section obtains a space amount of the supplying section before exchanging the accommodating section; an initial amount calculating section calculates an initial amount of developer in the accommodating section after exchanged on the basis of the space amount and an accommodating amount of the accommodating section; a use amount calculating section calculates a use amount of the developer used by the developing section; a judging section judges an existence/inexistence of the developer in the accommodating section on the basis of the initial amount and the use amount; and an informing section informs user of a judgment result when the judging section judges that the toner does not exist.

9 Claims, 11 Drawing Sheets

PRIOR ART

IMAGE FORMING APPARATUS WHICH INFORMS A USER THAT TONER DOES NOT EXIST IN AN EXCHANGEABLE DEVELOPER ACCOMMODATING SECTION

FIELD OF THE INVENTION

The invention relates to an image forming apparatus which has a developing device on which an accommodating section to accommodate developer is exchangeably installed, especially, relates to an image forming apparatus which can inform user after developer in an accommodating section is exhausted.

BACKGROUND OF THE INVENTION

Until now, an image forming apparatus is well known, on which a developing device is installed for performing a development process by using developer such as toner and the like (For example, it may refer to the following Patent Document 1).

Patent Document 1: Japan patent publication of No. Heisei 2000-238374.

In such developing device, in order to supply the developer, there is a case to establish and use an exchangeable accommodating section of cartridge type.

FIG. 13 is a diagram showing a structure of a former developing device.

As shown by FIG. 13, a developing device 90 comprises a developing section 91 for forming electrostatic latent image; a supplying section 92 for supplying developer to the developing section 91; and an accommodating section 93 which is exchangeably installed on the supplying section 92 and accommodates the developer.

The developing section 91, as shown by FIG. 13, comprises a photosensitive drum 94 which as an image carrying body. Moreover, around the photosensitive drum 94, a charging roller 95 which uniformly charges the surface of the photosensitive drum 94; an exposing unit 96 used for exposing the surface of charged photosensitive drum 94 and forming electrostatic latent image; and a developing roller 97 used for making the developer adhere to the electrostatic latent image and forming a developer image on the surface of the photosensitive drum 94, are respectively arranged.

In the supplying section 92, as shown by FIG. 13, a supplying roller 98 that is used for supplying developer for the developing roller 97, and a developing blade 99 that is used for forming uniform developer layer the developing roller 97, are connected with and arranged on the surface of the developing roller 97. Moreover, in the supplying section 92, a detecting section 100 used for detecting reduction of supplied and consumed developer from the accommodating section 93 is established.

However, in the former developing device 90 above mentioned, because the detecting section 100 is installed under installation position of the accommodating section 93, after the accommodating section 93 became empty and a long time passed, the reduction of the developer is detected. Then, the developing device 90 requires user to exchange the accommodating section 93. Therefore, even if the accommodating section 93 becomes empty, there is also a problem that the user can not immediately grasp such state.

For solving the problem above mentioned, a way to set the detecting section 100 beside the installation position of the accommodating section 93 is considered, but also there are problems about cost and so on.

Therefore, when the developer in the accommodating section is exhausted, an image forming apparatus capable of informing user of the state is expected without changing the position of the detecting section.

THE EFFECT OF THE PRESENT INVENTION

According to the image forming apparatus of the present invention, though the position of the detecting section is not changed, because it becomes possible to inform the user when the developer in the accommodating section is exhausted, improvement of convenience is realized by low cost.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail herein below with reference to the drawings.

Embodiment 1

Figure 2:
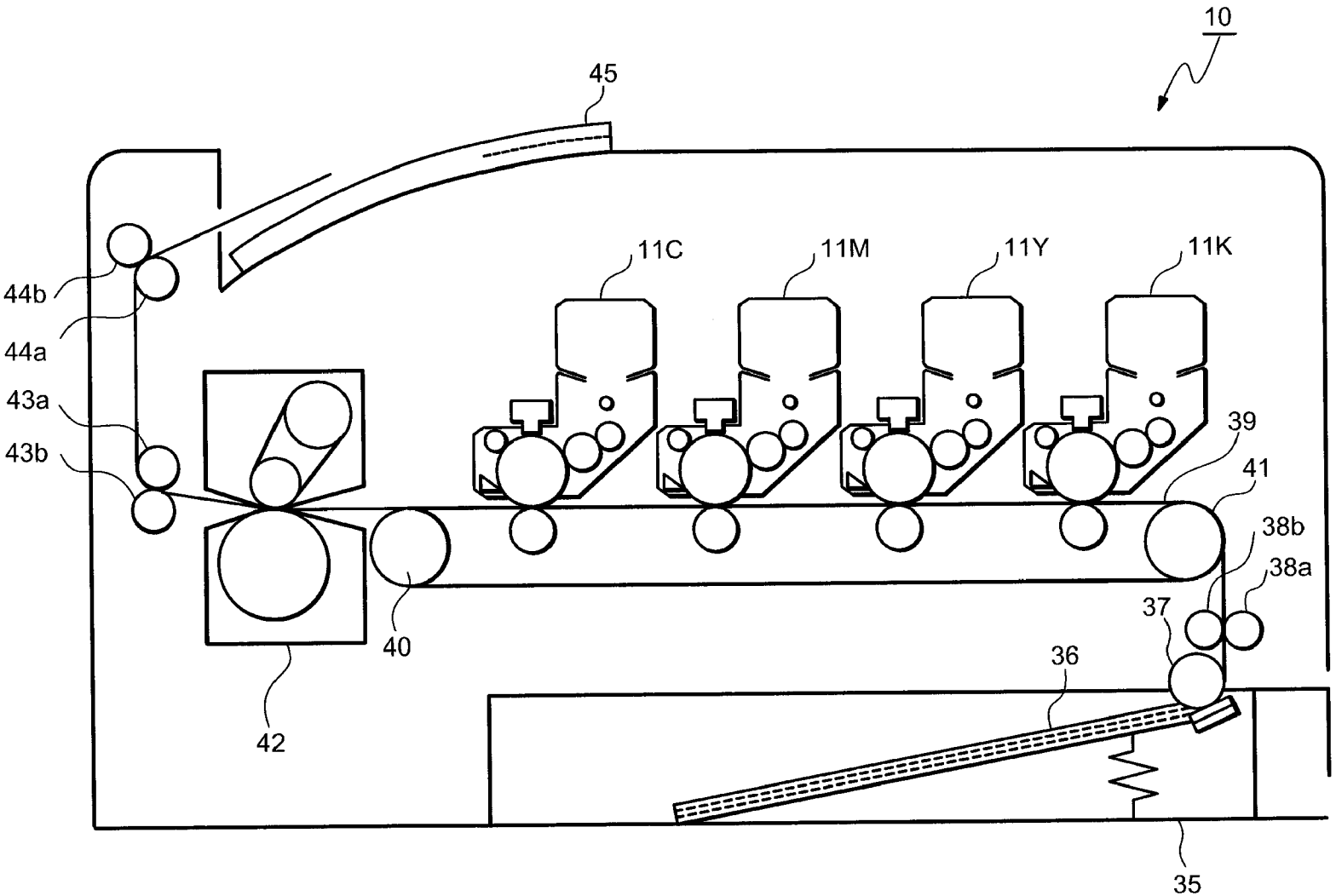
FIG. 2 is a diagram showing a summary structure of printer of the present invention.

FIG. 2 is a diagram showing a summary structure of printer of the present invention.

A printer 10 of the present embodiment, as an image forming apparatus on which a developing device is installed, overlaps toners i.e. developers of 4 colors of black, yellow, magenta and cyan so as to form a color image.

On the low part of the printer 10, a paper tray 35 used for accommodating paper 36, and a separating roller 37 are furnished. The separating roller 37 separates respective papers 36 in the paper tray 35 one by one, and respectively sends them to the interspace of conveying rollers 38*a* and 38*b*. Then, the paper 36 is conveyed by the conveying rollers 38*a* and 38*b*, and is fed onto a transferring belt 39.

The transferring belt 39 is formed as an endless band, as shown by FIG. 2, is extended between a drive roller 40 and an idle roller 41, and is rotatively moved through a drive of the drive roller 40.

On the transferring belt 39, along running instruction of the transferring belt 39, 4 independent developing units 11K, 11Y, 11M and 11C are installed in sequence.

The developing units 11K, 11Y, 11M and 11C are respectively printing mechanisms of electrophotographic type, with respect to respective colors of black, yellow, magenta and cyan; and respectively have a same structure as shown by FIG. 2 in the present embodiment 2. From now on, in order to distinguish respective developing units 11, symbols of K, Y, M, C are added respectively, in general case, only number is represented.

Here, it is to explain about a structure of the developing unit 11 by using from FIG. 3 to FIG. 6.

Figure 3:
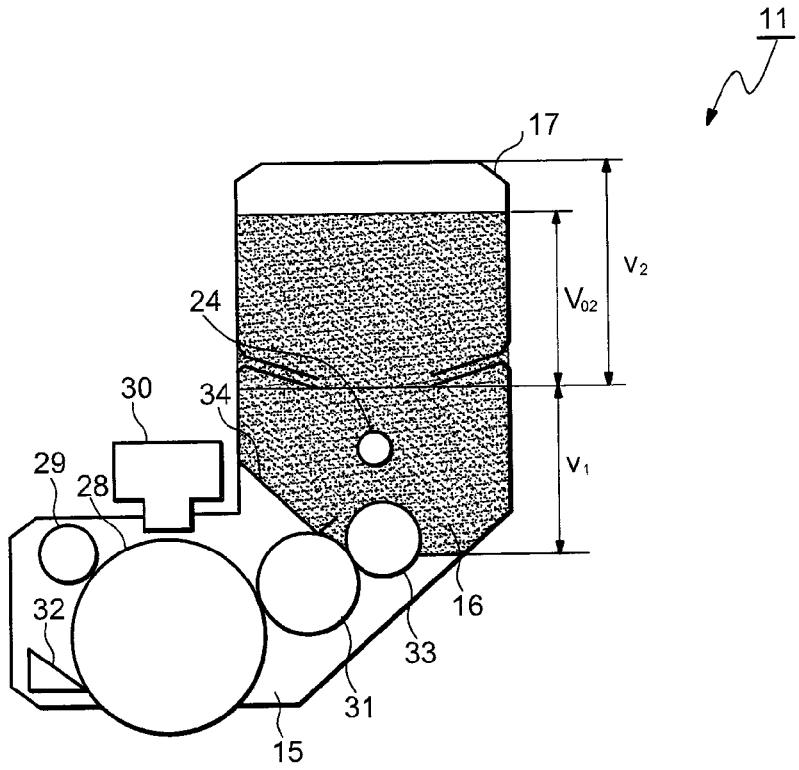
FIG. 3 is a first diagram showing a structure of a developing unit.
Figure 4:
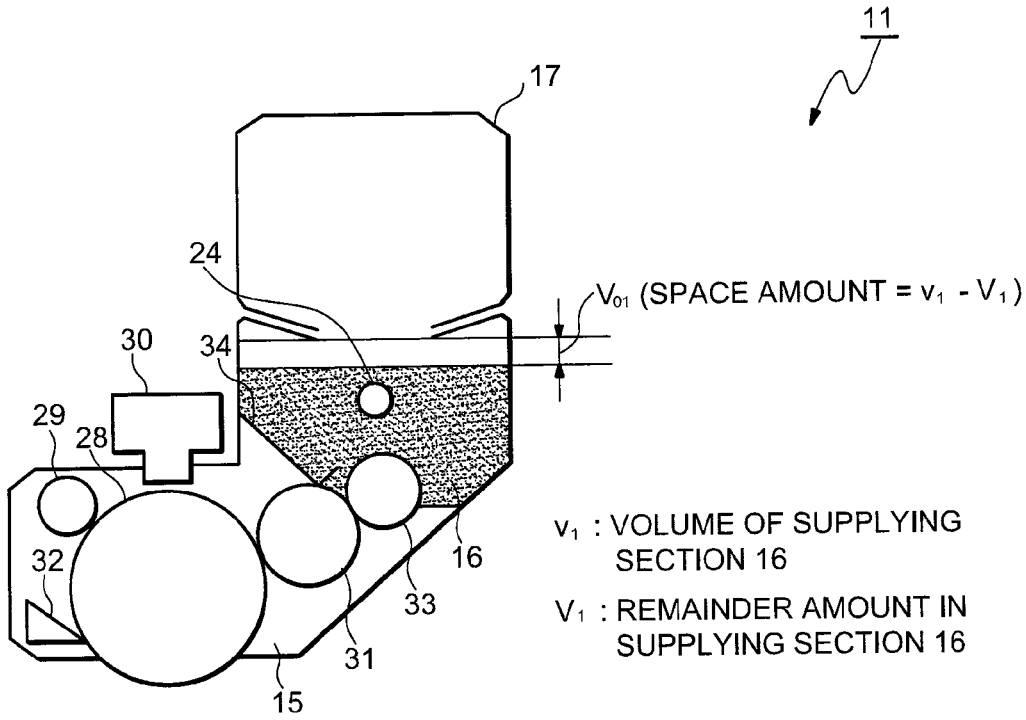
FIG. 4 is a second diagram showing a structure of a developing unit.
Figure 5:
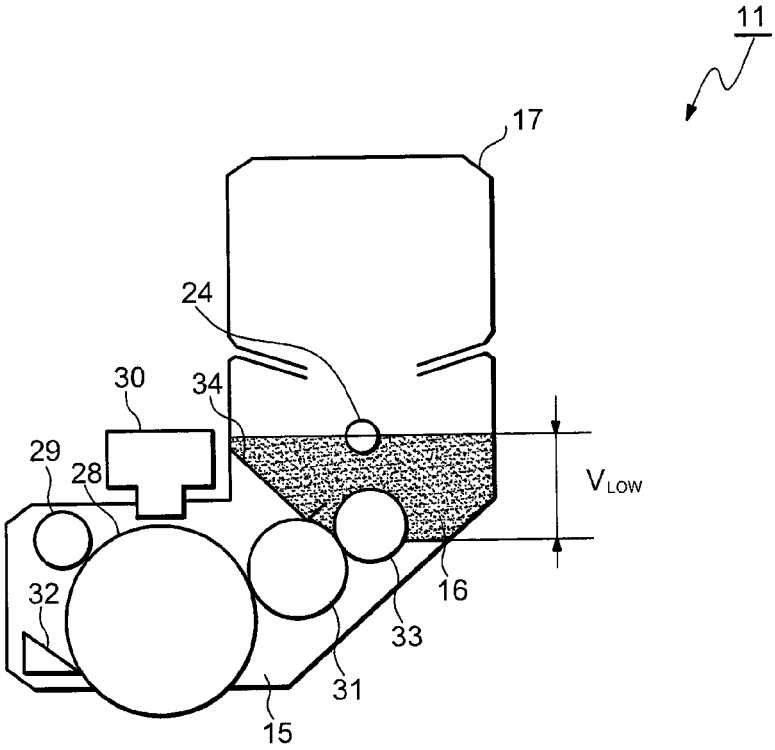
FIG. 5 is a third diagram showing a structure of a developing unit.
Figure 6:
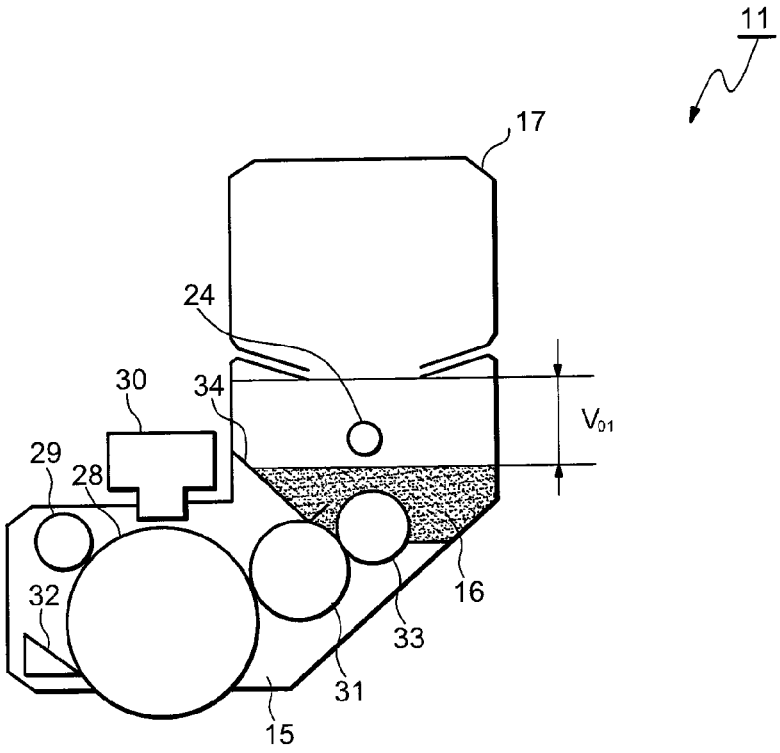
FIG. 6 is a fourth diagram showing a structure of a developing unit.

FIG. 3 is a first diagram showing a structure of a developing unit; FIG. 4 is a second diagram showing a structure of a developing unit; FIG. 5 is a third diagram showing a structure of a developing unit; and FIG. 6 is a fourth diagram showing a structure of a developing unit.

The developing unit 11, as a developing device, as shown by FIG. 3 to FIG. 6, comprises a developing section 15, a supplying section 16 and a toner cartridge 17.

The developing section 15 has a photosensitive body drum 28 as an image carrying body on which a toner image is formed on surface. Further, in the developing section 15, around the photosensitive body drum 28, a charging roller 29 that is a charging unit used for uniformly charging the surface of the photosensitive drum 28, a developing roller 31 that is a developer carrying body, a removing electrostatic light source 32 that is used for removing electrostatic of the photosensitive body drum 28, are respectively arranged. Furthermore, an exposing unit 30 that is used for exposing the surface of the charged photosensitive body drum 28 and forming an electrostatic latent image on the basis of image data, is installed in a main part of the printer 10.

The supplying section 16 has a sponge roller 33 as a toner supplying material and a developing blade 34. The sponge roller 33 and the developing blade 34 are connected and installed in the developing roller 31, supplies toner on the surface of the developing roller 31, and forms uniform toner layer.

Further, in the supplying section 16, a toner sensor 24 as a toner detecting section for detecting reduction of toner in the supplying section 16 is furnished.

On the supplying section 16, the toner cartridge 17 as an accommodating section for accommodating toner is exchangeably installed. The toner cartridge 17, on the condition of being installed on the supplying section 16, supplies toner to an space part in the inner of the supplying section 16, that is, to a part where toner is not accommodated.

The supplying section 16 receives and accommodates the supplied toner from the toner cartridge 17. The accommodated toner in the supplying section 16 is used with the execution of the development processing in the developing unit 11, as shown by FIG. 3 to FIG. 6, and the total amount of toner in the toner cartridge 17 and the supplying section 16 is reduced.

The paper 36 that has been fed on the transferring belt 39, with the rotative movement of the transferring belt 39, is conveyed to the lower part of the developing unit 11K. Then, a black toner image that has been formed on the surface of the photosensitive body drum 28K, is transferred on the surface of the paper 36. Continuously, the paper 36 is conveyed to the lower part of respective developing units 11Y, 11M and 11C in order, the toner images of respective colors are transferred on the paper 36 in order. Then, the paper 36 on which 4 color images have been transferred, is further conveyed to the fixing section 42, with the rotative movement of the transferring belt 39.

The fixing section 42 heats and presses the conveyed paper 36, dissolves the transferred toner images of respective colors on the paper 36, and makes them fix on the surface. The paper 36 on which toner image is fixed, after being further conveyed to conveying rollers 43*a* and 43*b*, is ejected to a stacker section 45 that is set up on the printer 10 through ejecting rollers 44*a* and 44*b*.

Further, on the printer 10, a panel (not shown) is furnished.

Next, it is to explain about a controlling system of the printer 10 in the present embodiment.

Figure 1:
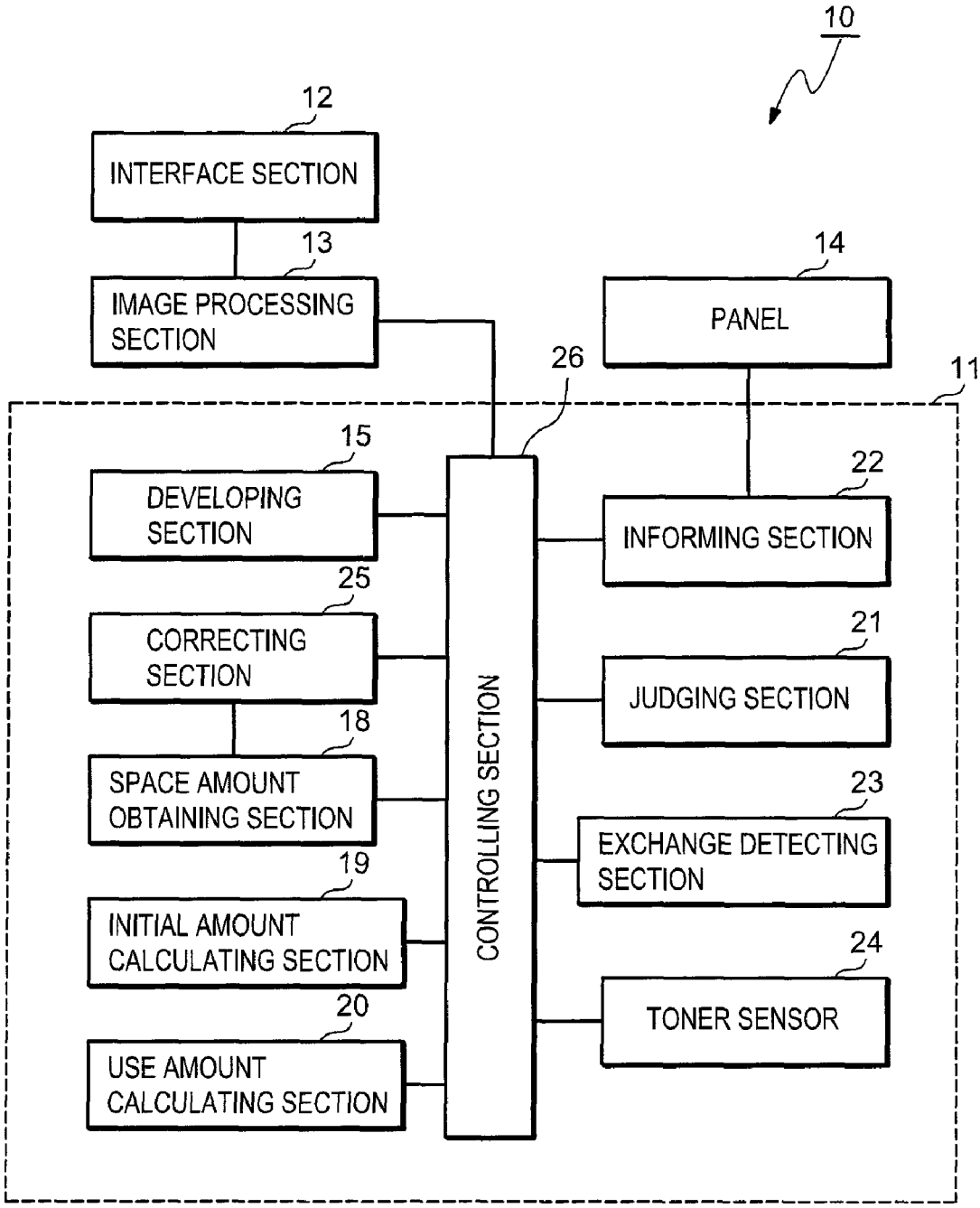
FIG. 1 is a block diagram showing a function structure of printer in embodiment 1 of the present invention.

FIG. 1 is a block diagram showing a function structure of printer in embodiment 1 of the present invention.

The printer 10 of the present embodiment, as shown by FIG. 1, comprises a interface section 12, an image processing section 13, a panel 14, a developing section 15, a space amount obtaining section 18, a initial amount calculating section 19, a use amount calculating section 20, a judging section 21, a informing section 22, an exchange detecting section 23, a toner sensor 24, a correcting section 25 and a controlling section 26.

The interface section 12, as a receiving section, receives the sent print data from an upper apparatus (not shown), and outputs the print data to the image processing section 13.

The image processing section 13, as an analyzing and obtaining section, analyses print data output from the interface section 12; generates every page of the image data for printing, obtains a page number that, as a received page number "n", corresponds to pages of the generated image data to be developed; and outputs the image data and the received page number "n" to the controlling section 26.

The panel 14 has a displaying function of displaying various information, and displays a message representing an exchange time of the toner cartridge 17 in order to inform the user that the toner cartridge 17 is empty on the basis of the control of the informing section 22 mentioned below. Further, the panel 14 displays a message representing "toner LOW" in order to inform the user of reduction of toner remainder amount in the developing unit 11. Furthermore, the panel 14 displays a message representing toner exhaustion in order to inform the user that the toner does not exist in the developing unit.

The developing section 15, on the basis of the input image data from the controlling section 26, forms electrostatic latent image on the photosensitive body drum 28 (FIG. 3), develops the electrostatic latent image, and forms a toner image. The developing section 15 performs a formation of the toner image per page.

The space amount obtaining section 18 obtains a space amount of the supplying section 16. Here, the space amount is a capacity of a space part in the supplying section 16, that is, the part where toner is not accommodated. In the present embodiment, the total toner accommodation amount of the supplying section 16 is regarded as a supplying section toner accommodation amount $v_1$. Further, the amount of toner which is accommodated in the supplying section 16 is regarded as a supplying section toner amount $V_1$. In the case, the space amount obtaining section 18 calculates a space amount $V_{01}$ on the basis of a formula $V_{01}=v_1-V_1$.

The initial amount calculating section 19 calculates an amount of toner in the toner cartridge 17 just after exchanged, as an initial amount $V_{02}$. In the present embodiment, a total toner accommodation amount of new toner cartridge 17 for exchanging is regarded as a cartridge capacity $v_2$. In the case, an accommodated toner amount in the toner cartridge 17 just before exchanging equals to the cartridge capacity $v_2$, a toner amount that is moved from the toner cartridge 17 to the supplying section 16 just after exchanged, equals to the space amount $V_{01}$ of the supplying section 16. Therefore, the initial amount calculating section 19 calculates an initial amount $V_{02}$ on the basis of a formula $V_{02}=v_2-V_{01}$.

The use amount calculating section 20 has a count function, and calculates an accumulated use amount $\Delta V$ of toner used by the developing section 15. In the present embodiment, the use amount calculating section 20 previously stores a toner average use amount of each page in general print processing execution in the printer 10, as a page use amount $\Delta v_0$. The use amount calculating section 20 multiplies the page use amount $\Delta v_0$ by the received page number "n" that is informed from the controlling section 26, and calculates a use amount $\Delta v=n\times\Delta v_0$ of each use. Then, the use amount calculating section 20 regards the accumulated use amount $\Delta V$ that has been calculated previously as an accumulated use amount $\Delta V'$; and adds the calculated use amount $\Delta v$ to the accumulated use amount $\Delta V'$; and then calculates an accumulated use amount $\Delta V=\Delta V'+\Delta v_0$. Further, the use amount calculating section 20, on the basis of a initialization instruction output from the controlling section 26, initializes the accumulated use amount $\Delta V$, that is $\Delta V=0$.

The judging section 21 compares the initial amount $V_{02}$ of the toner cartridge 17 just after exchanged, with the accumulated use amount $\Delta V$ used after exchanged, and judges whether or not toner exists in the toner cartridge 17. In the case that the accumulated use amount $\Delta V$ is more than the initial amount $V_{02}$ and a condition formula $\Delta V\geqq V_{02}$ is tenable, the judging section 21 judges that the toner does not exist in the toner cartridge 17, that is, judges that the toner cartridge 17 is empty. Further, in the case that the accumulated use amount $\Delta V$ is less than the initial amount $V_{02}$ and a condition formula $\Delta V<V_{02}$ is tenable, the judging section 21 judges that the toner still exists in the toner cartridge 17. The judging section 21 informs the controlling section 26 of the judgment result.

The informing section 22 controls the panel 14 to inform user of a toner remainder amount in the toner cartridge 17 or in the supplying section 16.

The exchange detecting section 23 is installed beside installation position of the toner cartridge 17 in the supplying section 16, and after the toner cartridge 17 is dismantled from the supplying section 16, it detects that a new toner cartridge 17 is installed, and outputs a detection signal to the controlling section 26. The exchange detecting section 23 reads information from RFID that is set in the toner cartridge 17, and detects an installation of the new toner cartridge 17 through comparing it with former information.

The toner sensor 24, as shown by the FIG. 3 to FIG. 6, is a sensor established in a predetermined position of the supplying section 16. When the toner sensor 24 reduces use of the toner accommodated in the supplying section 16, and top of the toner reaches setting position of the toner sensor 24, it detects the reach as "toner LOW", and outputs a detecting signal to the controlling section 26. Here, when the "toner LOW" is detected by the toner sensor 24, the toner amount that is accommodated in the supplying section 16 is displayed as a detecting amount $V_{LOW}$.

Further, beside the base of the supplying section 16, a toner sensor (not shown) is established, toner exhaustion the supplying section 16 is detected, and a detecting signal is outputted to the controlling section 26.

The correcting section 25, on the basis of control of the controlling section 26, corrects the space amount $V_{01}$ that is obtained through the space amount obtaining section 18. When the "toner LOW" is detected by the toner sensor 24, the correcting section 25 corrects the space amount $V_{01}$ to $V_{01}=v_1-V_{LOW}$ based on the detected toner amount $V_{LOW}$.

The controlling section 26 has a controlling function of each section mentioned above. When the image data and the received page number "n" from the image processing section 13 is input, the controlling section 26 sends the image data to the developing section 15, and informs the use amount calculating section 20 of the received page number "n". Further, when the detecting signal from the exchange detecting section 23 is inputted, the controlling section 26 makes the space amount obtaining section 18 act; and initializes the accumulated use amount $\Delta V$ through the use amount calculating section 20. Furthermore, when the detecting signal from the toner sensor 24 is inputted, the controlling section 26 makes the correcting section 25 act, and initializes the accumulated use amount $\Delta V$ through the use amount calculating section 20.

Next, it is to explain operation of the printer 10 in the present embodiment.

Figure 7:
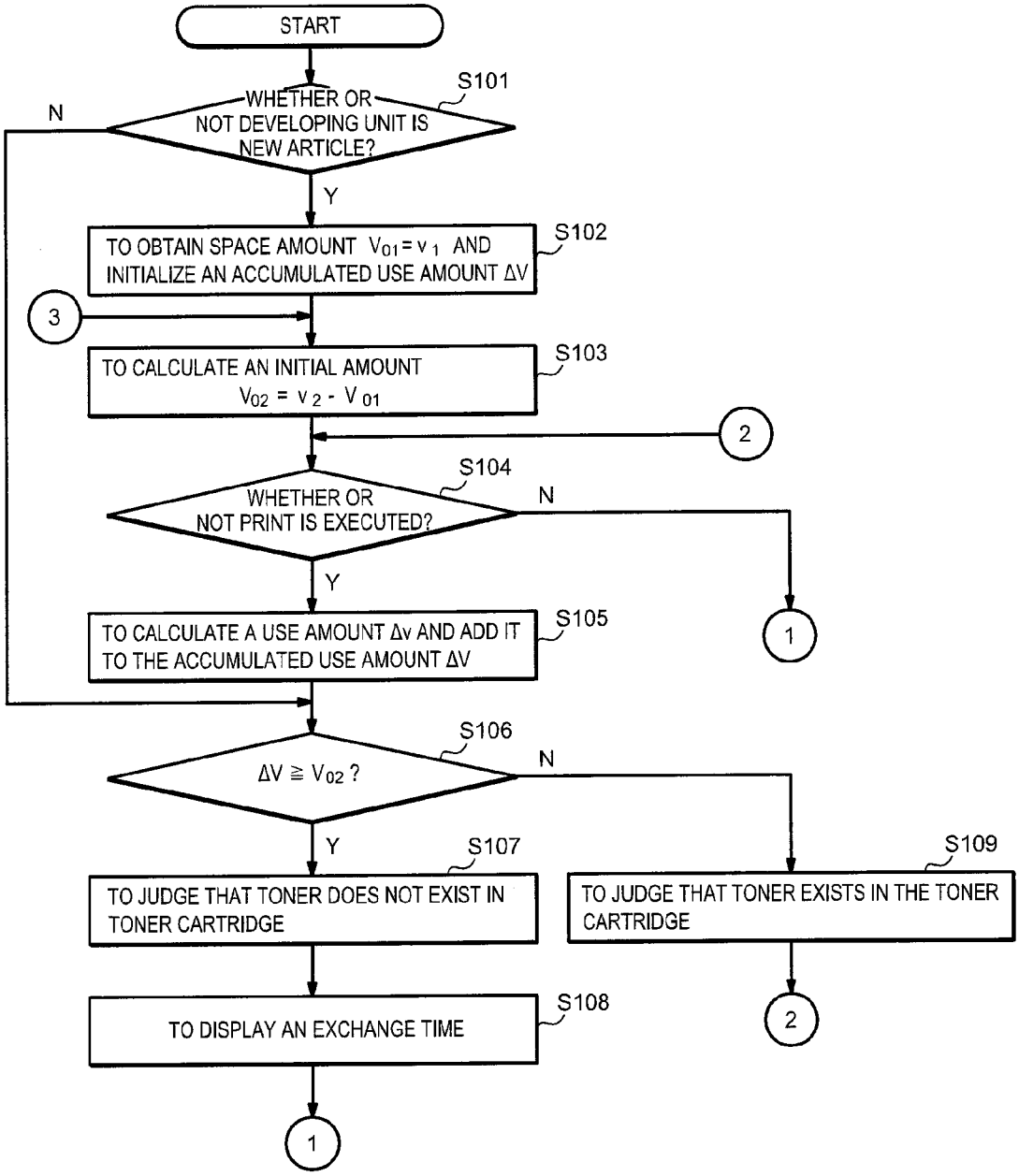
FIG. 7 is a first flow chart for explaining calculation judgment operation of printer in embodiment 1 of the present invention.
Figure 8:
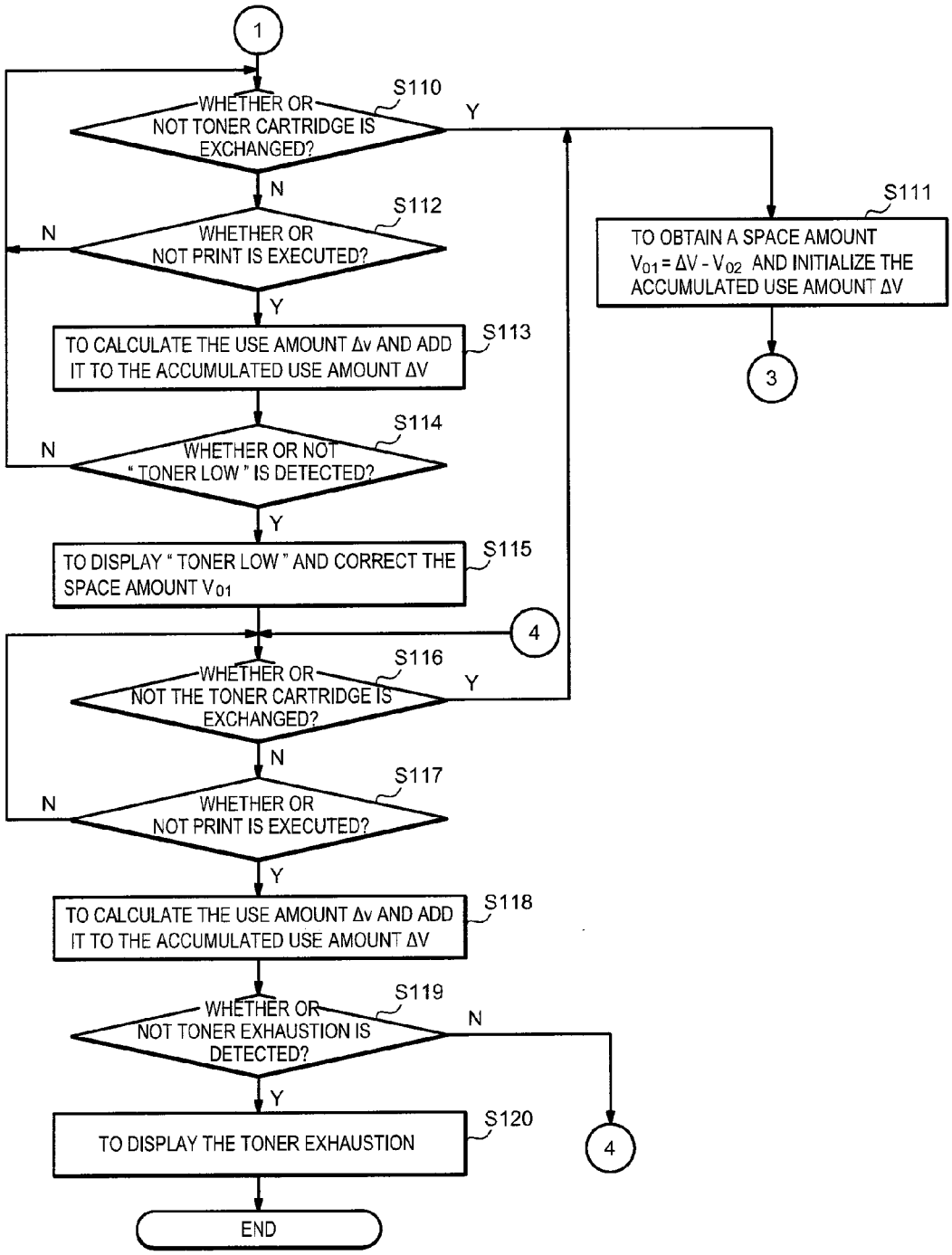
FIG. 8 is a second flow chart for explaining calculation judgment operation of printer in embodiment 1 of the present invention.

Here, it is to explain calculation judgment process for calculating a toner amount through the developing section 15 and judging whether or not there is toner in the toner cartridge 17 by using FIG. 7 and FIG. 8.

FIG. 7 is a first flow chart for explaining calculation judgment operation of printer in embodiment 1 of the present invention; and FIG. 8 is a second flow chart for explaining calculation judgment operation of printer in embodiment 1 of the present invention.

Firstly, it is to explain an example in the case that a developing unit 11 of new article is installed in the printer 10, after print process is executed, the toner cartridge 17 becomes empty and exchange period is informed.

In the printer 10, when the developing unit 11 is new article (step S101), the supplying section 16 is empty, the toner of the cartridge amount $v_2$ in the toner cartridge 17 is accommodated. At this time, a space amount of the supplying section 16 just before the toner cartridge 17 is installed, equals to a toner accommodated amount $v_1$ of the supplying section, the space amount obtaining section 18 obtains the space amount $V_{01}=v_1$ on the basis of control of the controlling section 26 (step S102). The space amount obtaining section 18 informs the controlling section 26 of the obtained space amount $V_{01}$. Further, the controlling section 26 initializes the accumulated use amount $\Delta V$ through the use amount calculating section 20, and makes $\Delta V=0$ (step S102).

Continuously, the controlling section 26 calculates the initial amount $V_{02}$ of the toner cartridge 17 though the initial amount calculating section 19 (step S103). The toner cartridge 17 is installed in the supplying section 16, and after the toner moves from the toner cartridge 17 to the supplying section 16, the initial amount calculating section 19 calculates the initial amount $V_{02}$ of the toner that is accommodated in the toner cartridge 17 on the basis of formula $V_{02}=v_2-V_{01}$ (step S103). The initial amount calculating section 19 calculates an initial amount $V_{02}=v_2-V_{01}$ by using the obtained space amount $V_{01}=v_1$ through the space amount obtaining section 18, and informs the controlling section 26 of it.

In the printer 10, when the interface section 12 receives print data, print process is executed on the basis of the print data (step S104). The image processing section 13 generates image data by analyzing the print data; and obtains received page number "n", and outputs the image data and the received page number "n" to the controlling section 26. The controlling section 26 sends the image data to the developing section 15, and the developing section 15 executes developing process on the basis of the image data.

Further, the controlling section 26 informs the use amount calculating section 20 of the received page number "n" that is inputted from the image processing section 13. Then, the use amount calculating section 20 calculates a use amount $\Delta v = n \times \Delta v_0$ of the toner that is used by the developing section 15 on the basis of the control of the controlling section 26, adds the use amount $\Delta v$ to a accumulated use amount $\Delta V'$ of being calculated end, and calculates an accumulated use amount $\Delta V = \Delta V' + \Delta v$ after developing process (step S105). The use amount calculating section 20 informs the controlling section 26 of the calculated accumulated use amount $\Delta V$.

Next, the controlling section 26 informs the judging section 21 of the initial amount $V_{02}$ and the accumulated use amount $\Delta V$. Then, the judging section 21 compares the informed initial amount $V_{02}$ with the accumulated use amount $\Delta V$ (step S106).

When the accumulated use amount $\Delta V$ is less than the initial amount $V_{02}$, that is $\Delta V < V_{02}$ (step S106), the judging section 21 judges that the toner exists in the toner cartridge 17, and informs the controlling section 26 of the judgment result (step S109). Then, the printer 10 continues to print on the basis of the control of the controlling section 26 (step S104).

When the accumulated use amount $\Delta V$ is or over the initial amount $V_{02}$, that is $\Delta V \geqq V_{02}$ (step S106), the judging section 21 judges that the toner does not exist in the toner cartridge 17 (step S107). The judging section 21 informs the controlling section 26 of the judgment result.

When the controlling section 26 is informed of the judgment result from the judging section 21, it sends an information indication to the informing section 22. Then, the panel 14 displays exchange period of the toner cartridge 17 through the control of the informing section 22 (step S108).

As above mentioned, the initial amount $V_{01}$ of the toner in the toner cartridge 17 just after exchange is compared with the accumulated use amount $\Delta V$ of the toner after exchange, and existence/inexistence of the toner in the toner cartridge 17 is judged. Then, when it is judged that the toner does not exist, the user is informed of the exchange period of the toner cartridge 17.

Next, after the information of the exchange period, it is to explain about a case that the toner cartridge 17 is exchanged.

In the printer 10, when the toner cartridge 17 that has become empty is dismantled from the supplying section 16, and a new toner cartridge 17 is installed, the exchange detecting section 23 detects the exchange of the toner cartridge 17, and outputs a detecting signal (step S110).

When the detecting signal is inputted from the exchange detecting section 23, the controlling section 26 informs the space amount obtaining section 18 of the initial amount $V_{02}$ of being calculated end by the initial amount calculating section 19 and the accumulated use amount $\Delta V$ of being calculated by the use amount calculating section 20, and makes the space amount obtaining section 18 act. Here, the initial amount $V_{02}$ is the amount of the toner that is accommodated in the exchange toner cartridge 17 just after the toner cartridge 17 is exchanged last time, that is cartridge toner amount (FIG. 3), and the accumulated use amount $\Delta V$ is total amount of the toner that is used after the toner cartridge 17 is exchanged last time. The space amount obtaining section 18, on the basis of the information from the controlling section 26, obtains the space amount $V_{01}$ (FIG. 4) of the supplying section 16 just before exchanging the toner cartridge 17 this time on the basis of the formula $V_{01} = \Delta V - V_{02}$ (step S111). Further, the controlling section 26 initializes the accumulated use amount $\Delta V$ through the use amount calculating section 20, that is $\Delta V = 0$ (step S111).

Continuously, the initial amount calculating section 19, on the basis of the control of the controlling section 26, calculates the initial amount $V_{02}$ of toner in the toner cartridge 17 just after exchanged (step S103). In the new toner cartridge 17, toner of cartridge capacity $v_2$ is accommodated, and in this toner, toner corresponding to the space amount $V_{01}$ of the supplying section 16, moves from the toner cartridge 17 to the supplying section 16. Therefore, the initial amount calculating section 19 calculates the initial amount $V_{02}$ just after the exchange on the basis of the formula $V_{02} = v_2 - V_{01}$ (step S103).

Then, the printer 10 executes the print process on the basis of the print data received through the interface section 12 (step S104). The printer 10, on the basis of the control of the controlling section 26, adds it to the accumulated use amount $\Delta V$ by calculating the use amount $\Delta v$ (step S105), compares the calculated accumulated use amount $\Delta V$ with the initial amount $V_{02}$ (step S106), and judges existence/inexistence of the toner in toner cartridge 17.

As above mentioned, when the toner cartridge 17 is exchanged, the initial amount $V_{01}$ of the toner cartridge 17 just after exchanged is calculated once more; and the accumulated use amount $\Delta V$ of being calculated end is initialized.

Moreover, in the step S101, when the developing unit 11 is not new article, the judging section 21 judges existence/inexistence of the toner in the toner cartridge 17 (step S106). On the basis of the judgment result, the printer 10 executes the following process of step S107.

Next, it is to explain a case that after the toner cartridge 17 becomes empty, the print process is continued without exchanging the toner cartridge 17.

After exchange period is displayed in the panel 14 (step S108), the print process is continued (step S112) without exchanging the toner cartridge 17 (step S110), the use amount calculating section 20 continues to calculate the accumulated use amount $\Delta V$ on the basis of the control of the controlling section 26 (step S113).

With the execution of the print process, the toner in the supplying section 16 is reduced by being used. Then, as shown by FIG. 5, when top of the toner reaches a set position of the toner sensor 24, the toner sensor 24 detects a "toner LOW", and outputs a detecting signal (step S114).

When the detecting signal is inputted from the toner sensor 24, the controlling section 26 instructs to display the "toner LOW" in the informing section 22. Then, on the basis of the control of the informing section 22, the panel 14 displays the "toner LOW" (step S115). Further, the correcting section 25 corrects the space amount $V_{01}$ of the supplying section 16 obtained by the space amount obtaining section 18 to a detecting space amount $V_{01} = v_1 - V_{LOW}$ on the basis of the detecting toner amount $V_{LOW}$ (step S115).

As above mentioned, when the "toner LOW" is detected by the toner sensor 24, the space amount $V_{01}$ that is calculation amount is corrected on the basis of the detecting toner amount $V_{LOW}$.

After the detection of the "toner LOW", the toner cartridge 17 is exchanged (step S117), and when the detecting signal from the exchange detecting section 23 is inputted, the controlling section 26 makes the space amount obtaining section 18 obtain the space amount $V_{01} = \Delta V - V_{02}$ of the toner cartridge 17 just before exchange; and initializes the use amount calculating section 20 (step S111). Then, on the basis of the calculated space amount $V_{01}$, the use amount calculating section 20 calculates the initial amount $V_{02}=v_2-V_{01}$ just after exchange (step S103).

After the detection of the "toner LOW", when the print process is continued (step S118) without exchanging the toner cartridge 17 (step S117), the use amount calculating section 20 further continues to calculate the accumulated use amount ΔV (step S119).

Later, when toner exhaustion of the supplying section 16 is detected by toner sensor (not shown) and the detecting signal is inputted to the controlling section 26 (step S120), the controlling section 26 instructs the informing section 22 to display toner exhaustion. Then, on the basis of the control of the informing section 22, the panel 14 displays toner exhaustion (step S121).

As above mentioned, the printer 10 in the present embodiment, calculates the use amount of the toner used in each developing unit 11 per use, and through comparing the use amount with the initial amount of the toner in the toner cartridge 17, because existence/in existence of the toner in the toner cartridge 17 is judged, it is possible to inform the user of exchange period of the toner cartridge 17 without changing position of the toner sensor 24 just after the toner cartridge 17 becomes empty. Therefore, with position change of the sensor, cost becomes unnecessary; and before the toner in the developing unit 11 is all exhausted and print becomes impossible, because it becomes possible for the user to prepare toner cartridge used for exchanging, convenience is improved. Further, because the printer 10 can correct the calculating amount on the basis of the detecting amount through the toner sensor 24, the more accurate judgment becomes possible.

Moreover, in the present embodiment, the use amount calculating section 20 accumulates the use amount of the toner of the toner cartridge 17 from being exchanged to next being exchanged, and though calculates the accumulated use amount, it is not limited in the present invention. For example, it is also possible to get a structure of calculating the remainder amount of the toner in the toner cartridge 17 of each print process. In the embodiment 2, it is to explain about the structure.

Embodiment 2

Figure 9:
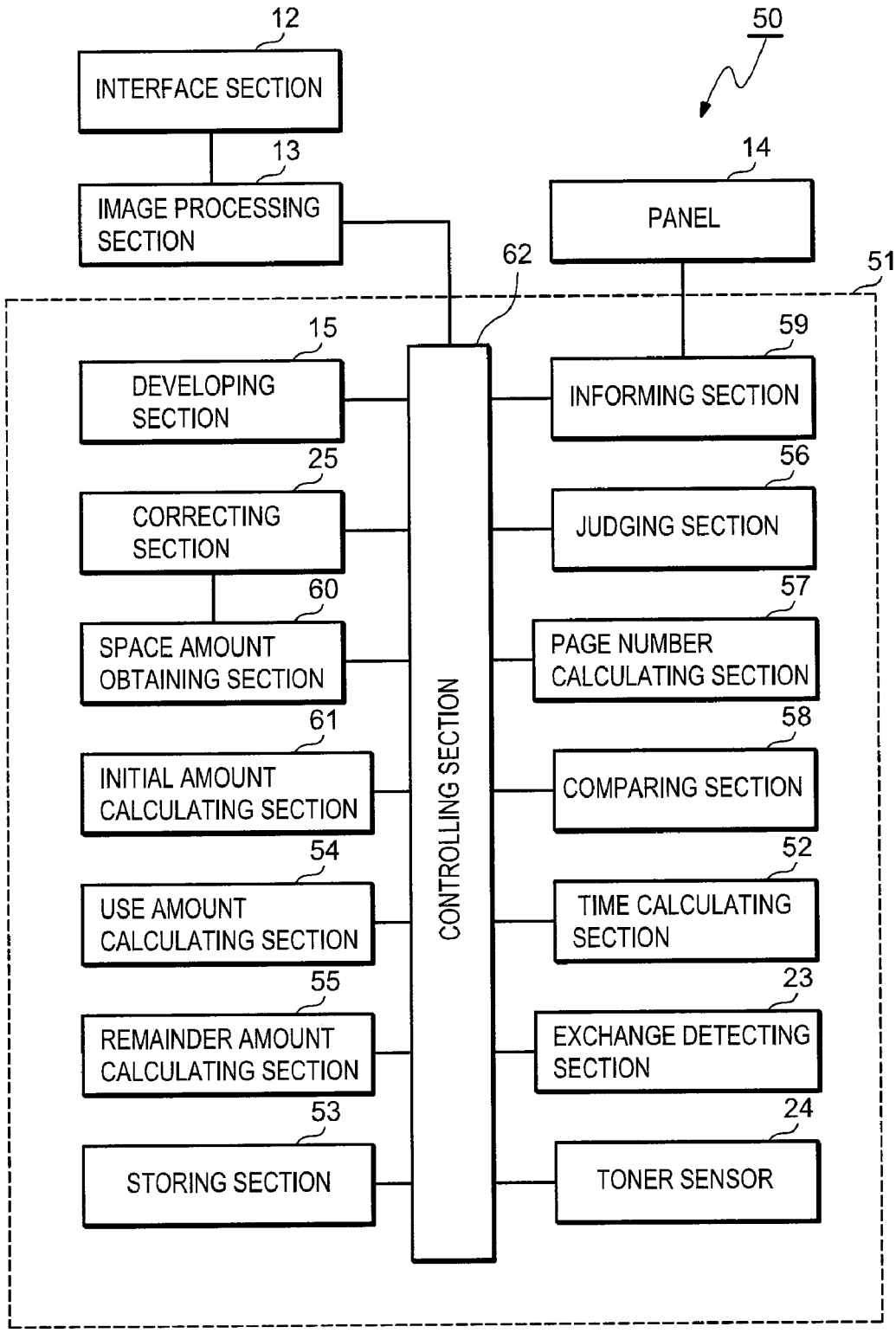
FIG. 9 is a block diagram showing a function structure of printer in embodiment 2 of the present invention.

FIG. 9 is a block diagram showing a function structure of printer in embodiment 2 of the present invention.

A printer 50 in this embodiment has a composition of a time calculating section 52 that is added to a developing unit 51, so the printer 50 is different from that in the embodiment 1.

Moreover, in this embodiment, the same composition with the embodiment 1 is represented by the same mark, so detailed explanation about these is omitted.

The printer 50 in this embodiment, as shown by FIG. 9, comprises an interface section 12, an image processing section 13, a panel 14, a developing section 15, a storing section 53, an use amount calculating section 54, a remainder amount calculating section 55, a judging section 56, a page number calculating section 57, a comparing section 58, a time calculating section 52, an informing section 59, a exchange detecting section 23, a toner sensor 24, a correcting section 25 and a controlling section 62.

The storing section 53 previously stores an average use amount of toner of each page in execution of general print process in the printer 50 as page use amount $\Delta v_0$. Further, the storing section 53 previously stores an average development time of each page in execution of general print process in the printer 50 as page development time $\Delta t_0$.

The use amount calculating section 54 calculates a use amount Δv of toner used by the developing section 15. The use amount calculating section 54 calculates the $\Delta v=n\times\Delta v_0$ of each use on the basis of the page use amount $\Delta v_0$ stored in the storing section 53 and the received page number "n" informed from the controlling section 62.

The remainder amount calculating section 55, after executing developing process by the developing section 15, calculates a remainder amount of the toner accommodated in the toner cartridge 17 as cartridge toner amount $V_2$. The remainder amount calculating section 55, on the basis of an initial amount $V_{02}$ corresponding to cartridge toner amount before the developing process execution and the use amount Δv with the developing process execution, calculates a cartridge toner amount $V_2=V_{02}-\Delta v$.

The judging section 56, on the basis of the cartridge amount $V_2$, judges existence/inexistence of the toner in the toner cartridge 17 after developing process execution. When $\Delta V_2\leqq 0$, the toner does not exist in the toner cartridge 17 after developing process execution, that is the judging section 56 judges that the toner cartridge 17 becomes empty. When $\Delta V_2>0$, the toner exists in the toner cartridge 17 after developing process execution, that is the judging section 56 judges that the toner cartridge 17 does not become empty.

The page number calculating section 57, on the basis of the cartridge toner amount $\Delta V_2$ and the page use amount $\Delta v_0$, calculates developing possible page of the developing section 15 until the toner in the toner cartridge 17 is exhausted as a remainder page number "N". The page number calculating section 57 performs calculation of the remainder page "N" on the basis of a formula $N=\Delta V_2/\Delta v_0$.

The comparing section 58 judges magnitude by comparing the received page number "n" with the remainder page number "N".

The time calculating section 52, on the basis of the remainder page number "N" and the page development time $\Delta t_0$, calculates time needed by development of an image data corresponding to the remainder amount "N" as development time Δt. The time calculating section 52, on the basis of a formula $\Delta t=N\times\Delta t_0$, performs calculation of the development time Δt.

The informing section 59 informs user of exchange period of the toner cartridge 17 and the development time Δt until the exchange period by controlling the panel 4.

The space amount obtaining section 60 obtains a space amount $V_{01}$ of the supplying section 16. When the cartridge toner amount $V_2$ calculated by the remainder amount calculating section 55 is below 0, the space amount obtaining section 60 obtains the space amount $V_{01}=|V_2|$.

The initial amount calculating section 61 calculates toner amount in the toner cartridge 17 just after exchange as an initial amount $V_{02}$. Further, when the cartridge toner amount $V_2$ after developed of being calculated end by the remainder amount calculating section 55 exceeds 0, the initial amount calculating section 61 obtains the initial amount $V_{02}=V_2$.

The controlling section 62 has a controlling function of each section in the printer 50. The controlling section 62, when image data and the received page number "n" from the image processing section 13 are inputted, temporarily stores the image data (not shown) in the temporary storing section and informs the comparing section 58 of the received page number "n". Then, when the received page number "n" is under the remainder page number "N", the controlling section 62 sends the image data to the developing section 15. When the received page number "n" is or over the remainder page number, the controlling section 62 instructs the time calculating section 52 to calculate the development time Δv, and after made the development time Δv inform by the informing section 59, sends the image data to the developing section 15.

Next, it is to explain about operation of the printer 50 in this embodiment.

Figure 10:
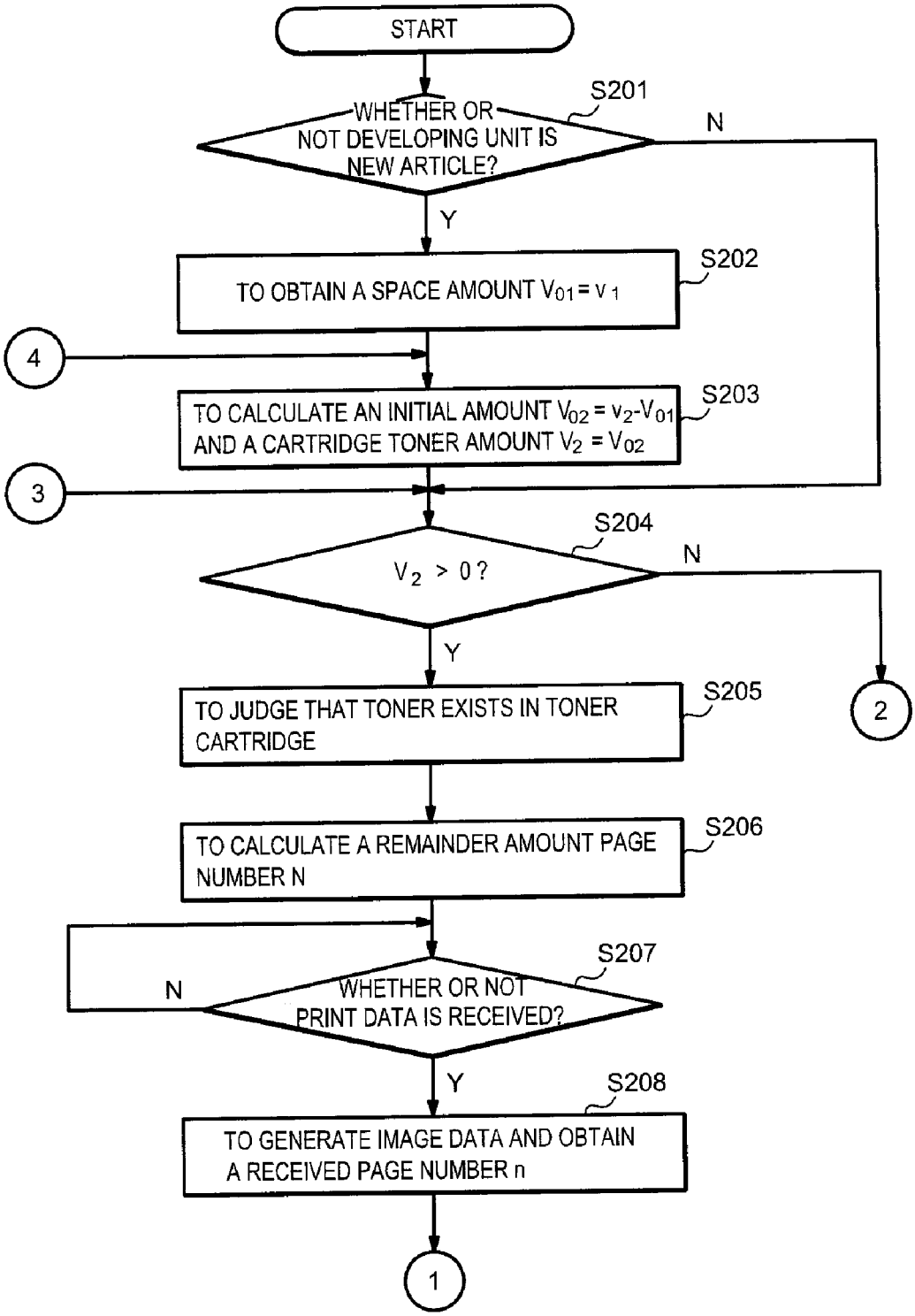
FIG. 10 is a first flow chart for explaining calculation judgment operation of printer in embodiment 2 of the present invention.
Figure 11:
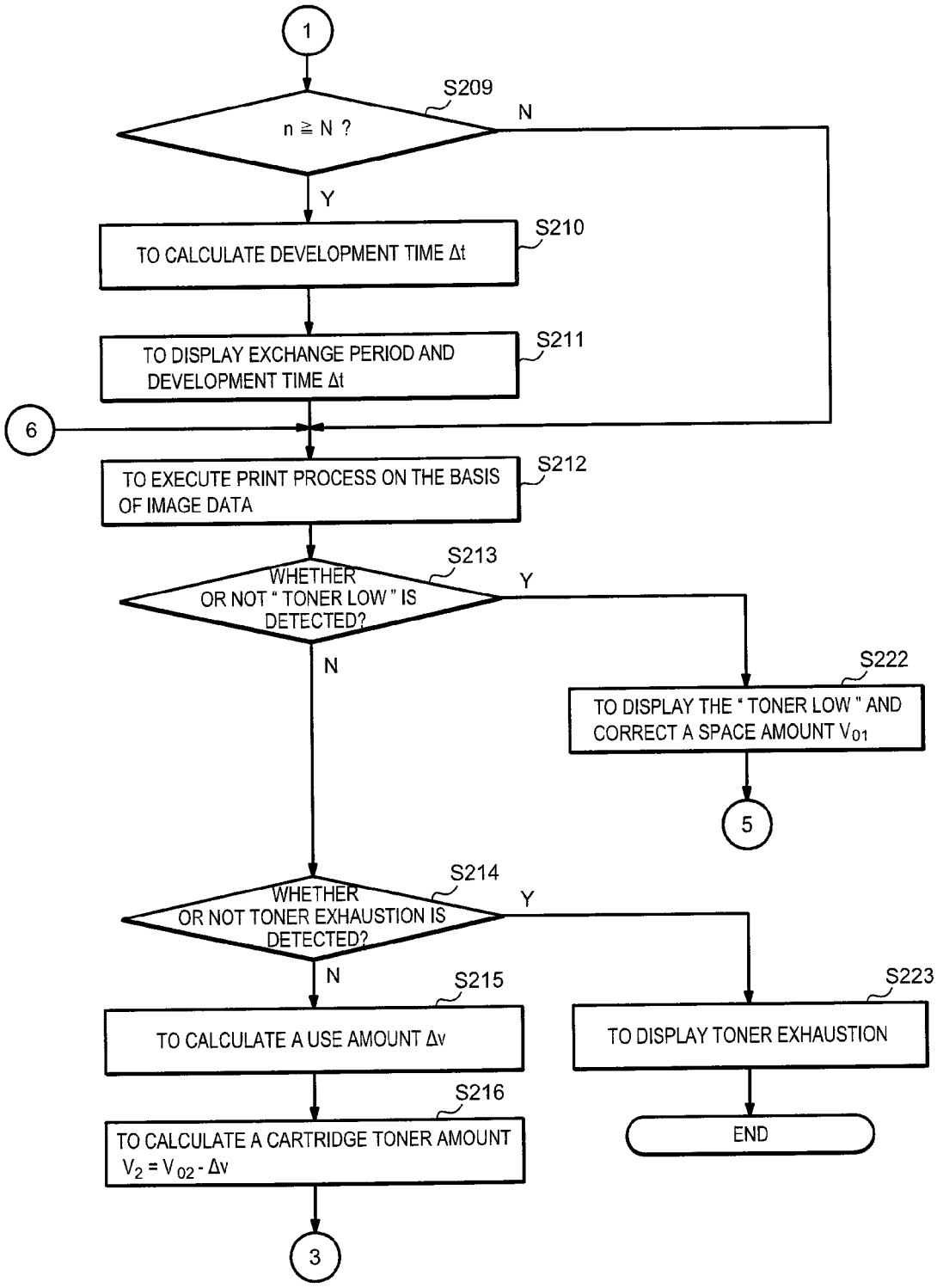
FIG. 11 is a second flow chart for explaining calculation judgment operation of printer in embodiment 2 of the present invention.
Figure 12:
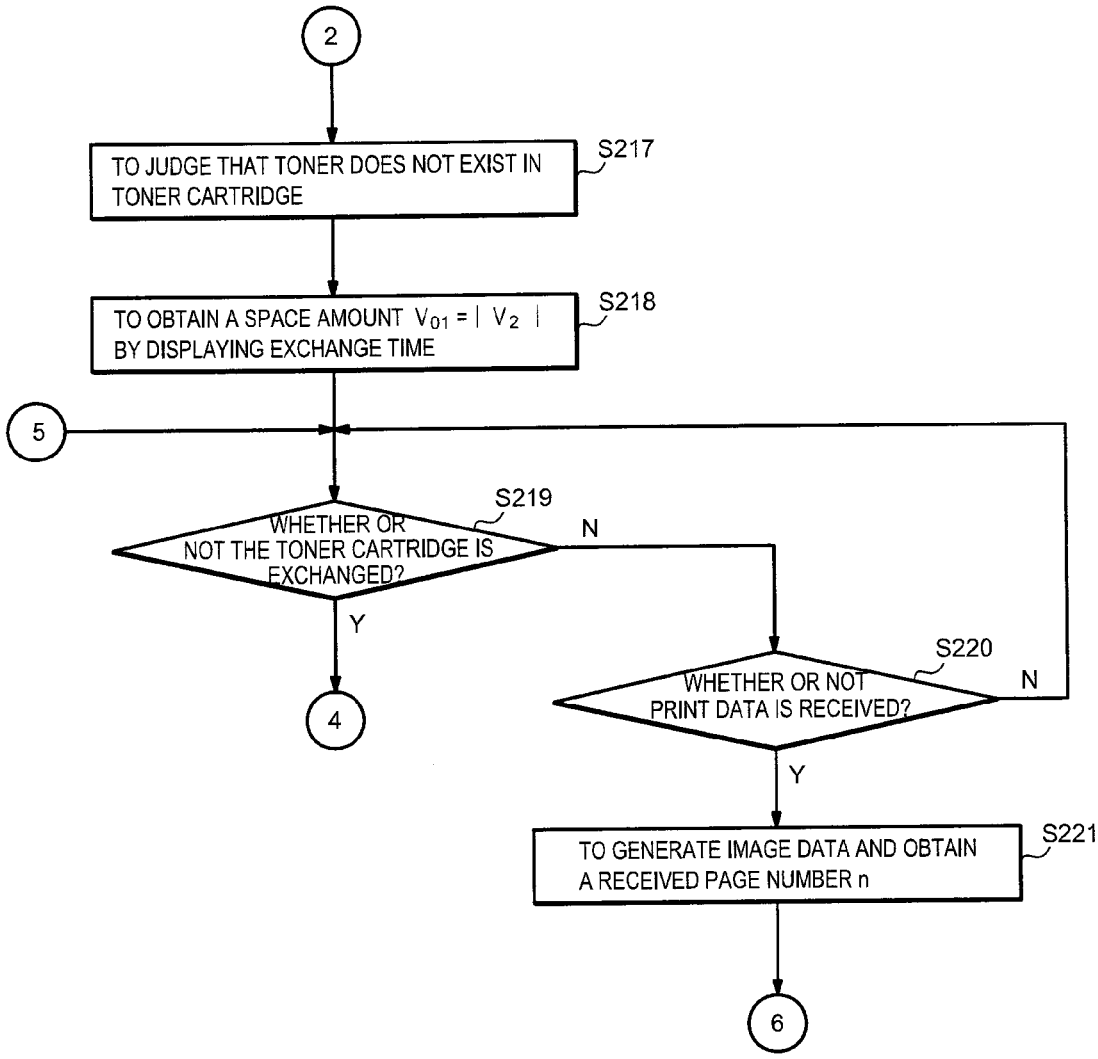
FIG. 12 is a third flow chart for explaining calculation judgment operation of printer in embodiment 2 of the present invention.
Figure 13:
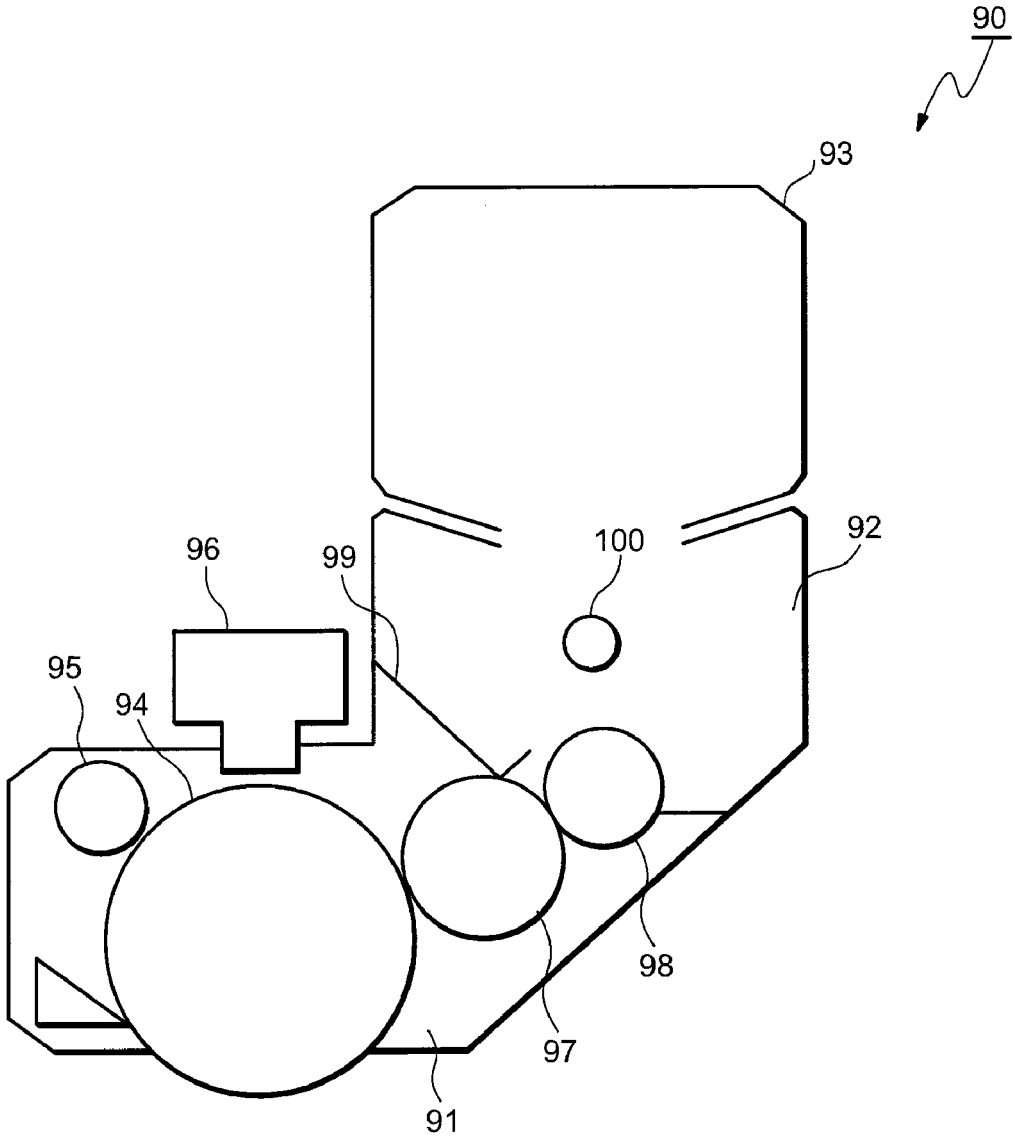
FIG. 13 is a diagram showing a structure of a former developing device.

Here, it is to explain about calculation judgment process of the printer 50 by using FIG. 10 to FIG. 12.

FIG. 10 is a first flow chart for explaining calculation judgment operation of printer in embodiment 2 of the present invention; FIG. 11 is a second flow chart for explaining calculation judgment operation of printer in embodiment 2 of the present invention; and FIG. 12 is a third flow chart for explaining calculation judgment operation of printer in embodiment 2 of the present invention.

Firstly, it is to explain an example in the case that the developing unit 51 of new article is installed in the printer 50, after print data is received, exchange period of the toner cartridge 17 is informed.

In the printer 50, when the developing unit 51 is new article (step S201), the space amount obtaining section 60, on the basis of toner accommodated amount $v_1$ of the supplying section in the supplying section 16, obtains a space amount $V_{01}=v_1$, and informs the controlling section 62 of it (step S202).

Continuously, the controlling section 62 informs the initial amount calculating section 61 of the space amount $V_{01}$, the initial amount calculating section 61 calculates an initial amount $V_{02}=v_2-V_{01}=v_2-v_1$ of the toner in the toner cartridge 17 (step S203). Further, the controlling section 62 informs the remainder amount calculating section 55 of the initial amount $V_{02}$ and the use amount Δv=0, and the remainder amount calculating section 55 calculates a cartridge toner amount $V_2=V_{02}$ of the toner cartridge 17 (step S203).

Next, the controlling section 62 informs the judging section 56 of the cartridge toner amount $V_2$. Then, the judging section 56 judges the existence/inexistence of toner in the toner cartridge 17 on the basis of plus-minus of the cartridge toner amount $V_2$. When the developing unit 12 is new article, because the cartridge toner amount $V_2>0$ (step S204), the judging section 56 judges that toner exists in the toner cartridge 17 (step S205).

When it is judged that the toner exists in the toner cartridge 17 (step S205), the controlling section 62 informs the page number calculating section 57 of the cartridge toner amount $V_2$ and the page use amount $\Delta v_0$ that is stored in the storing section 53. The page number calculating section 57, on the basis of the informed cartridge toner amount $V_2$ and the page use amount $\Delta v_0$, calculates a remainder page number $N=V_2/\Delta v_0$, and informs the controlling section 62 of it (step S206).

In the printer 50, when the interface section 12 receives print data (step S207), the image processing section 13 generates the image data by analyzing the print data; and obtains the received page number "n", and then outputs the image data and the received page "n" to the controlling section 62 (step S208).

When the image data and the received page number "n" are inputted, the controlling section 62 stores the image data (not shown) in the temporary storing section. Further, the controlling section 62 informs the comparing section 58 of the inputted received page number "n" and the remainder page number "N" that is calculated by the page number calculating section 57. Then, the comparing section 58 compares magnitude of the received page number "n" and the remainder page number "N", and informs the controlling section 62 of the comparison result (step S209).

When the received page number "n" is or over the remainder page number "N", that is $n \geqq N$ (step S209), the controlling section 62 informs the time calculating section 52 of the remainder page number "N" and the page development time $\Delta t_0$ that is stored in the storing section 53. Then, the time calculating section 52, on the basis of the informed remainder page number "N" and the page development time $\Delta t_0$, calculates development time $\Delta t=N\times\Delta t_0$, and informs the controlling section 62 of it (step S210).

Continuously, the controlling section 62 sends an information instruction of the exchange period and the development time Δt to the informing section 59. Then, the panel 14 displays the exchange period of the toner cartridge 17 and the development time Δt through a control of the informing section 59 (step S211). In the panel 14, a message representing that the time until the toner cartridge 17 becomes empty is development time Δt, is displayed.

Later, the controlling section 62 reads the image data from the temporary storing section (not shown), and sends it to the developing section 15. Then, the printer 50 executes the print process on the basis of the image data (step S212).

As above mentioned, when the remainder page number "N" corresponding to the cartridge toner amount $V_2$ is calculated, and the remainder page number "n" is bigger than the remainder page number "N", execution of the print process is preceded, and the development time Δt which is the time until the toner cartridge 17 becomes empty, it is displayed in the panel 14.

Moreover, when the print process is completed on the basis of the image data without detection of the "toner LOW" (step S213) and the toner exhaustion (step S214), the controlling section 62 makes the use amount calculating section 54 calculate the use amount Δv (step S215). On the basis of the received page number "n" corresponding to the printed image data and the page use amount $\Delta v_0$ that is stored in the storing section 53, the use amount calculating section 54 calculates the use amount $\Delta v=n\times\Delta v_0$ (step S215).

Continuously, on the basis of the initial amount $V_0$ and the use amount Δv, the remainder amount calculating section 55 calculates the cartridge toner amount $V_2=V_0-\Delta v$, and informs the controlling section 62 of it (step S216).

The controlling section 62 informs the judging section 56 of the cartridge toner amount $V_2$. Then, on the basis of plus-minus of the cartridge toner $V_2$, the judging section 56 judges the existence/inexistence of toner in the toner cartridge 17 (step S204).

When the cartridge toner amount meets $V_2 \leqq 0$ (step S204), the judging section 56 judges that the toner does not exist in the toner cartridge 17 (step S217).

When it is judged that the toner does not exist (step S217), the controlling section 62 sends the information instruction to the informing section 59. Then, the panel 14 displays the exchange period of the toner cartridge 17 through a control of the informing section 59 (step S218). Further, the space amount obtaining section 60, on the basis of the cartridge amount $V_2$ obtaining negative value, obtains the space amount $V_{01}=|V_2|$ of the supplying section 16 (step S218).

As above mentioned, when it is judged that the toner does not exist in the toner cartridge 17, user is informed of the exchange period.

After the display of the exchange period (step S218), and when the toner cartridge 17 is dismantled and a new toner cartridge 17 is installed, the exchange detecting section 23 outputs a detecting signal (step S219).

When the detecting signal from the exchange detecting section 23 is inputted, the controlling section 62 informs the initial amount calculating section 61 of the space amount $V_{01}$.

Then, the initial amount calculating section 61 calculates the initial amount $V_{02}=v_2-V_{01}$ of the toner in the toner cartridge 17 (step S203). Further, the controlling section 62 informs the remainder amount calculating section 55 of the initial amount $V_{02}$ and the use amount $\Delta v=0$, the remainder amount calculating section 55 calculates the cartridge toner amount $V_2=V_{02}$ (step S203).

As above mentioned, when the toner cartridge 17 is exchanged, the cartridge amount $V_2$ is calculated.

In step S201, when the developing unit 51 is not new article, the controlling section 62 judges the existence/inexistence of the toner in the toner cartridge 17 through the judging section 56 (step S204). On the basis of the judgment result, the printer 50 executes the following process of step S205.

Next, it is to explain about a case that after the toner cartridge 17 becomes empty, the print process is continued without exchanging the toner cartridge 17.

In the execution of the print process (step S212), when the toner sensor 24 detects the "toner LOW", and outputs the detection signal (step S213), the controlling section 62 instructs the informing section 59 to display the "toner LOW". Then, on the basis of the control of the informing section 59, the panel 14 displays the "toner LOW" (step S222). Further, the correcting section 25 corrects the space amount $V_{01}$ of the supplying section 16 obtained through the space amount obtaining section 60 to the detecting space amount $V_{01}=v_1-V_{LOW}$ (step S222).

After the detection of the "toner LOW", when the toner cartridge 17 is exchanged (step S219), and the detection signal from the exchange detecting section 23 is inputted, on the basis of the control of the controlling section 62, the initial amount calculating section 61 calculates the initial $V_{02}=v_2-V_{01}$, and the remainder amount calculating section 55 calculates the cartridge amount $V_2=V_{02}$ (step S203).

Later, the print data is received through the interface section 12 (step S220) without exchanging the toner cartridge 17 (step S219), the image processing section 13 obtains the received page number "n" by generating the image data, and outputs the image data and the received page number "n" to the controlling section 62 (step S221).

Further, the controlling section 62 sends the image data to the developing section 15, and the printer 50 executes the print process on the basis of the image data (step S212).

In the execution of the print process, when the toner exhaustion of the supplying section 16 is detected through the toner sensor (not shown), the controlling section 62 instructs the informing section 59 to display the toner exhaustion. Then, on the basis of the control of the informing section 59, the panel 14 displays the toner exhaustion (step S223).

As above mentioned, the printer 50 of this embodiment, a developing process execution in the developing section 15 is preceded, calculates the remainder page number capable of developing until the toner in the toner cartridge 17 is exhausted, and in the case that the received page number is or over the remainder page number, it calculates the time spending in the development of the remainder page number, because the printer 50 informs the user of it, it becomes possible for user to grasp the remainder time until the toner cartridge 17 becomes exchangeable The Utilization Possibility on Industry In respective embodiments above mentioned, it is to explain a case of the printer of electrophotography type which uses toner as developer, but it is not limited in the present invention.

Further, in respective embodiments above mentioned, by using an in the general print process execution, the calculation of the use amount of the toner, but it is not limited in the present invention. For example, the use condition of the toner in the executed print process is recorded as a print log, and it becomes possible to calculate the use amount of the toner on the basis of average use amount of the toner of each page that is calculated on the basis of the print log. Further, on the basis of the dot number included in the image data, the use amount may also be calculated.

Further, in respective embodiments above mentioned, although the exchange period is informed by displaying a message in the panel of the printer, it is not limited in the present invention. For example, it is possible to inform the exchange period beside the upper apparatus that is a sending source of print data.

The present invention is not limited to the foregoing embodiments but many modifications and variations are possible within the spirit and scope of the appended claims of the invention.

What is claimed is:

1. An image forming apparatus that has a developing section that is used for developing an electrostatic latent image with a developer; an accommodating section that accommodates the developer; and a supplying section that makes the accommodating section be installed exchangeably, receives the developer from the accommodating section and supplies the developer to the developing section, comprising:

a space amount obtaining section that obtains a total amount of volumetric space where the developer does not exist in the supplying section before exchanging the accommodating section;

an initial amount calculating section that calculates an initial amount of developer in the accommodating section after the accommodating section is exchanged and developer whose amount corresponds to the total amount of volumetric space is supplied from the accommodating section on the basis of the obtained total amount of volumetric space and a total accommodating amount of the accommodating section;

a use amount calculating section that calculates a use amount of the developer used by the developing section;

a judging section that judges an existence/inexistence of the developer in the accommodating section on the basis of the initial amount and the use amount that have been calculated; and an informing section that informs a user of a judgment result when the judging section judges that the developer does not exist in the accommodating section.

2. The image forming apparatus according to claim 1, wherein the use amount calculating section accumulates the use amount to calculate an accumulated use amount; and the judging section compares the accumulated use amount with the initial amount and judges that developer does not exist in the accommodating section when the accumulated use amount is at or over the initial amount.

3. The image forming apparatus according to claim 2, wherein the space amount obtaining section obtains the total amount of volumetric space according to a difference between the accumulated use amount and the initial amount.

4. The image forming apparatus according to claim 3, further comprising:

an exchange detecting section that detects that the accommodating section is exchanged and outputs a detection signal; and a controlling section that makes the initial amount calculating section operate when the detection signal is outputted, wherein the use amount calculating section initializes the accumulated use amount on the basis of the detection signal.

5. The image forming apparatus according to claim 4, further comprising:

a developer detecting section that is furnished on a predetermined position corresponding to a predetermined space amount, detects a reduction of the developer in the supplying section and outputs a detection signal; and a correcting section that corrects the total amount of volumetric space to the predetermined space amount when the detection signal is detected.

6. The image forming apparatus according to claim 1, further comprising:

a receiving section that receives image data from an upper apparatus; and an analyzing and obtaining section that analyzes the received image data and obtains a page number corresponding to the image data to be developed as a received page number, wherein the use amount calculating section previously stores an average use amount of the developer of each page, and calculates the use amount on the basis of the average use amount and the received page number.

7. The image forming apparatus according claim 1, further comprising;

a receiving section that receives image data from an upper apparatus; and an analyzing and obtaining section that analyzes the received image data and obtains a dot number of dots included in the image data, wherein the use amount calculating section calculates the use amount on the basis of the obtained dot number.

8. The image forming apparatus according to claim 1, further comprising:

a remainder amount calculating section that calculates a remainder amount of the developer in the accommodating section from the initial amount on the basis of the use amount, wherein the use amount calculating section performs a calculation of the use amount per use;

the remainder amount calculating section correspondingly calculates the respective remainder amount with respect to respective use amounts; and the judging section judges that developer does not exist in the accommodating section when the calculated remainder amount is zero or less.

9. The image forming apparatus according to claim 8, further comprising:

a receiving section that receives image data from an upper apparatus;

an analyzing and obtaining section that analyzes the received image data and obtains a page number of pages corresponding to the image data to be developed, as a received page number;

a storing section that previously stores an average use amount and an average development time of developer of each page;

a page number calculating section that is used for calculating a page number of pages that can be developed until the developer in the accommodating section is exhausted and that corresponds to the remainder amount, as a remainder amount page number, on the basis of the remainder amount and the average use amount;

a time calculating section that is used for calculating a development time spent for developing image data of the remainder amount page number on the basis of the remainder amount page number and the average development time; and a comparing section that is used for comparing the received page number with the remainder amount page number, wherein the judging section judges that developer exists in the accommodating section when the remainder amount is over zero;

when the judging section judges that developer exists in the accommodating section, the page number calculating section calculates the remainder amount page number, and the comparing section performs the comparison operation; and when the received page number exceeds the remainder page number, the time calculating section calculates the development time, and the informing section further informs user of the calculated development time.

* * * * *